United States Patent [19]

Kobayashi

[11] Patent Number: 4,984,528

[45] Date of Patent: Jan. 15, 1991

[54] VENTING AND DRAIN ARRANGEMENT FOR SMALL WATERCRAFT

[75] Inventor: Noboru Kobayashi, Iwata, Japan

[73] Assignee: Yamaha Hatsudoki Kabushiki Kaisha, Iwata, Japan

[21] Appl. No.: 441,384

[22] Filed: Nov. 27, 1989

[30] Foreign Application Priority Data

Nov. 28, 1988 [JP] Japan ..... 63-301928

[51] Int. Cl.[5] ..... B63B 35/00

[52] U.S. Cl. ..... 114/270; 114/211; 440/88

[58] Field of Search ..... 114/183 R, 211, 212, 114/242, 270, 315, 334; 440/38, 40, 42, 43, 88, 89; 60/221, 222

[56] References Cited

U.S. PATENT DOCUMENTS

| | | | |
|---|---|---|---|
| 3,826,220 | 7/1974 | Jacobson | 440/42 |
| 3,890,920 | 6/1975 | Buelk | 114/315 |
| 4,348,976 | 9/1982 | Gilbert | 114/315 |
| 4,568,293 | 2/1986 | Yazaki | 114/211 |

*Primary Examiner*—Joseph F. Peters, Jr.
*Assistant Examiner*—Jesus D. Sotelo
*Attorney, Agent, or Firm*—Ernest A. Beutler

[57] ABSTRACT

A venting and drain arrangement for a small watercraft that is formed with a tunnel in which the propulsion unit for the watercraft is formed. The venting arrangement includes a vent pipe that extends through a venting recess formed in the hull to the engine compartment. A well is formed in the venting recess in which water can accumulate and a drain conduit extends from the well to the tunnel for discharging water to the body of water in which the watercraft is operating without necessitating holes that will be visible when the watercraft is operating.

8 Claims, 2 Drawing Sheets

VENTING AND DRAIN ARRANGEMENT FOR SMALL WATERCRAFT

BACKGROUND OF THE INVENTION

This invention relates to a venting and drain arrangement for a small watercraft and more particularly to an improved arrangement for venting .the engine compartment of such a watercraft and for draining water which may accumulate in the area of the vent passage.

The desirability of venting the engine compartment of a watercraft is well known. Various types of venting arrangements have been proposed. These generally include an inlet pipe that is positioned within a recessed area of the hull and which is covered by a cover plate so as to insure that water cannot flow directly into the engine compartment through the vent pipe. A well is formed in the recessed area around the vent pipe and any water which may enter into the venting area can accumulate in this well. Drain passages have been provided which extend from the well out through the sides of the hull to permit accumulated water to be discharged. Such arrangements, however, have a number of difficulties and disadvantages.

In the first instance, the positioning of drains that extend through the sides of the hull require multiple drains so that the water can drain from the venting area regardless of the orientation of the watercraft. That is, if the watercraft is leaning to one side or the other, it must be insured that the accumulated water can drain and this necessitates the use of plural drains. In addition to the foregoing disadvantage, the provision of drain openings in the side of the hull give an unsightly appearance and furthermore require reinforcing in the hull area around the drain opening.

It is, therefore, a principal object of this invention to provide an improved venting and drain arrangement for a small watercraft.

It is a further object of this invention to provide a water drain for the engine compartment vent of a small watercraft wherein only one drain passage need be provided and, furthermore, wherein the drain passage discharges back into the body of water in which the watercraft is operating through an opening that cannot be seen from the external area of the hull during normal operation.

SUMMARY OF THE INVENTION

This invention is adapted to be embodied in a hull construction for a small watercraft wherein the hull defines a tunnel on the underside for containing at least in part a propulsion unit for the watercraft. An engine compartment is formed within the hull for accommodating an internal combustion engine for driving the propulsion unit. A venting recess is formed in the upper portion of the hull and a vent pipe extends through the hull in the venting recess from an inlet end communicating with the atmosphere to an outlet end communicating with the engine compartment. A well is formed by the venting recess in which water may accumulate. Drain means extend from the well to the tunnel for draining water from the well to the body of water in which the watercraft is operating.

DETAILED DESCRIPTION OF THE PREFERRED EMBODIMENT

Figure 1:
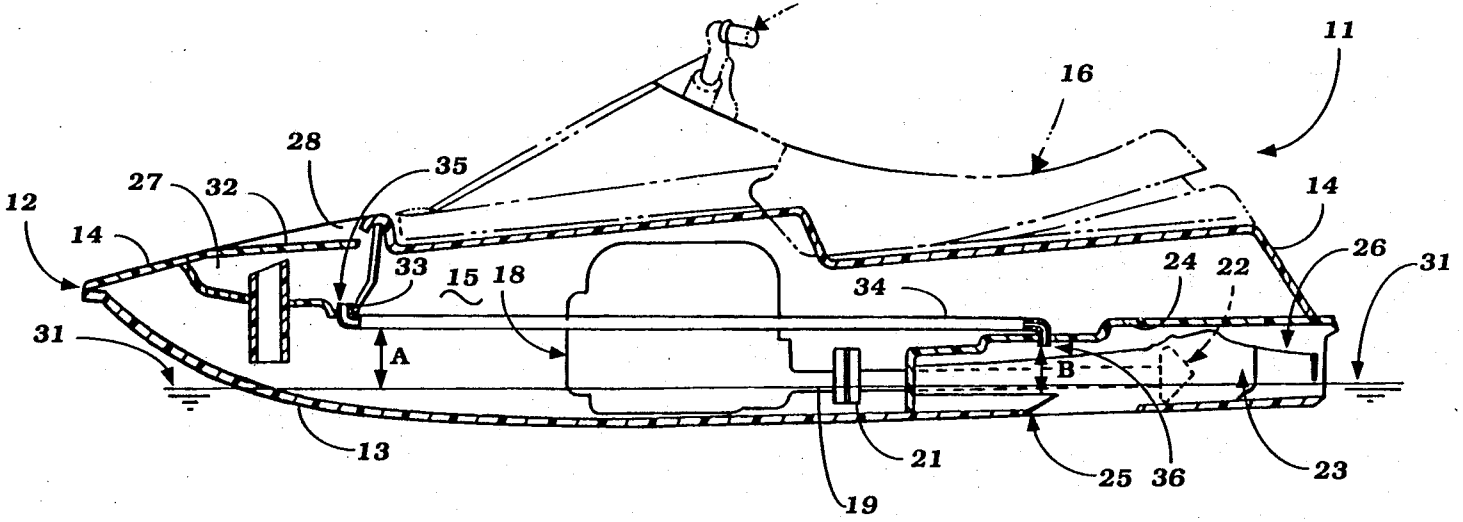
FIG. 1 is a longitudinal cross-sectional view taken through the hull of a small watercraft constructed in accordance with an embodiment of the invention, with portions shown in phantom.
Figure 2:
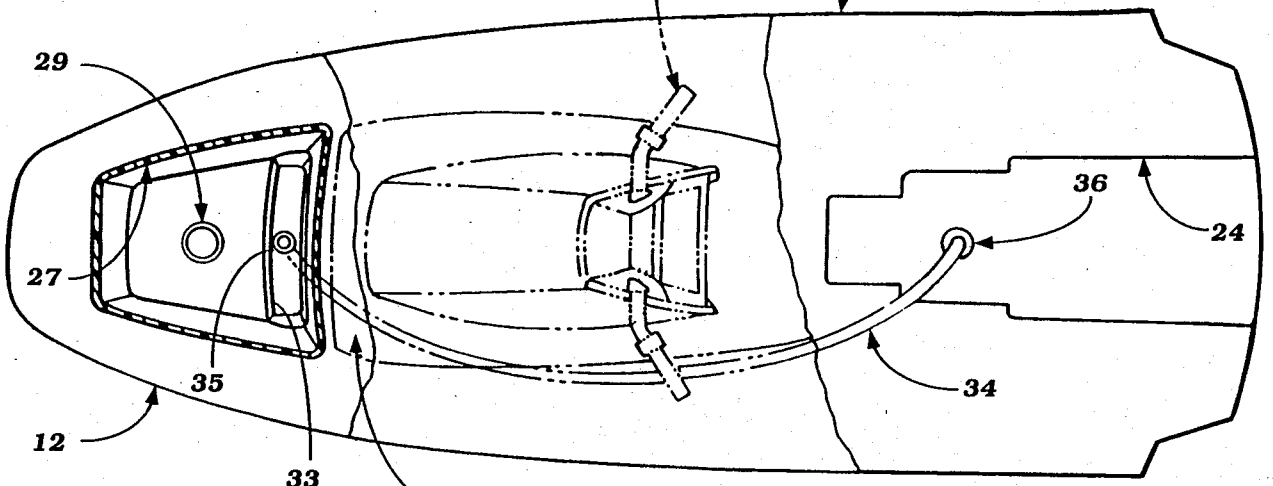
FIG. 2 is a top plan view of the small watercraft, with portions broken away and with portions shown in phantom.

Referring to the drawings, a small watercraft constructed in accordance with an embodiment of the invention is identified generally by the reference numeral 11. In the illustrated embodiment, the small watercraft 11 is depicted as being of the jet propelled type and is designed to be operated by a single rider sitting on the seat of the watercraft in a straddle fashion, as will become apparent. It is to be understood, however, that the invention can be utilized in conjunction with various other types of watercraft. The invention does, however, have particular utility in connection with watercraft powered by a jet propulsion unit, for a reason which will become apparent The watercraft 11 is comprised of a hull, indicated generally by the reference numeral 12 and which is comprised of a lower hull portion 13 and a deck portion 14. The lower portion 13 and deck portion 14 may conveniently be formed from a molded fiberglass reinforced resin as is well known in this art.

The hull 12 defines an engine compartment 15 that is positioned generally beneath and forwardly of a seat 16 carried by the deck portion 14 and upon which a rider is adapted to be seated in a straddle fashion, as aforenoted. A handlebar assembly 17 is provided forwardly of the seat 16 for steering operation of the watercraft 11 and also may contain suitable throttle controls.

An internal combustion engine 18 is provided in the engine compartment 15 and has its output shaft 19 coupled by means of an elastic coupling 21 to an input shaft which drives an impeller 22 of a jet propulsion unit, indicated generally by the reference numeral 23. The jet propulsion unit 23 is positioned within a tunnel 24 formed on the underside of the hull portion 13 to beneath the seat 16 and toward the rear end of the hull 12.

The jet propulsion unit 23 has a downwardly and forwardly facing water inlet 25 through which water is drawn by the operation of the impeller 22 and which is discharged through a pivotally supported steering nozzle 26. As is well known, the pivotal movement of the steering nozzle 26 effects steering of the watercraft 11.

A venting recess, indicated generally by the reference numeral 27 is formed by the deck portion 14 forwardly of the steering handlebar 17. The recess 27 has an inlet opening 28 which is in a sheltered location and through which vent air can be drawn into the venting recess 27. A vent pipe 29 extends from an inlet opening in the venting recess 27 to an outlet that is in communication with the engine compartment 15 but which is spaced above the normal water level, indicated by the line 31. The vent pipe 29 is sheltered by a portion 32 of the deck 14 that extends over the venting recess 27 so any water entering the opening 28 will not be drawn into the engine compartment 15.

A well or trough 33 extends across the rear of the venting recess 27 and is at the lowest portion of this recess. The well 33 is normally spaced a distance A above the height of the water line 31 and extends transversely across the venting recess 27 so as to insure that it will be able to accommodate a fairly substantial amount of water which may be ingested through the opening 28.

In order to drain water that accumulates in the well 33, there is provided a flexible conduit 34 that extends from an inlet opening 35 positioned centrally of the well 33 to an outlet opening 36 that communicates with the tunnel 24 at a distance B above the normal water level 31 so as to insure good draining. Because the drain opening 35 is positioned centrally of the well 33, only a single drain opening need be required and water will drain effectively regardless of the attitude of the watercraft 11. As a result, a very efficient, compact and neat drain arrangement is provided that does not require any openings in the outer side of the hull that could be seen when the watercraft 11 is in use. Furthermore, the construction avoids the necessity of forming any reinforcing around the drain openings to strengthen the hull since the openings are formed in areas of the hull that do not undergo any high loading.

It should be understood that the foregoing description is that of a preferred embodiment of the invention and that various changes and modifications may be made without departing from the spirit and scope of the invention, as defined by the appended claims.

I claim:

1. A hull construction for a small watercraft defining a tunnel on the underside of said hull for containing at least in part a propulsion unit, an engine compartment formed within said hull for accommodating an internal combustion engine for driving said propulsion unit, a venting recess formed in an upper portion of said hull, a vent pipe extending through said hull in said venting recess from an inlet end communicating with the atmosphere to an outlet end communicating with said engine compartment, a well formed by said venting recess in which water may accumulate, and drain means extending from said well to said tunnel for draining water from said well to the body of water in which said watercraft is operating.

2. A hull construction as set forth in claim 1 wherein the hull further forms a protective cowling portion extending over the inlet end of said vent pipe and defining an opening for admitting atmospheric air to the venting recess.

3. A hull construction as set forth in claim 2 wherein the well extends transversely across the venting recess.

4. A hull construction as set forth in claim 3 wherein the drain means has an inlet opening positioned centrally of the well.

5. A hull construction as set forth in claim 1 wherein the tunnel is formed so that at least the upper portion of the tunnel is disposed above the level of water when the hull is operating therein and the drain means outlet opening extends into the portion of the tunnel above the water level.

6. A hull construction as set forth in claim 5 wherein the hull further forms a protective cowling portion extending over the inlet end of said vent pipe and defining an opening for admitting atmospheric air to the venting recess.

7. A hull construction as set forth in claim 6 wherein the well extends transversely across the venting recess.

8. A hull construction as set forth in claim 7 wherein the drain means has an inlet opening positioned centrally of the well.

* * * * *